US009562703B2

(12) United States Patent
Base et al.

(10) Patent No.: US 9,562,703 B2
(45) Date of Patent: Feb. 7, 2017

(54) IN-LINE ULTRAPURE HEAT EXCHANGER

(71) Applicants: Howard J. Base, Macedonia, OH (US); Jack M. Geiger, Willoughby, OH (US); Joel Rozga, Leroy Township, OH (US); Mounir B. Ibrahim, Bay Village, OH (US)

(72) Inventors: Howard J. Base, Macedonia, OH (US); Jack M. Geiger, Willoughby, OH (US); Joel Rozga, Leroy Township, OH (US); Mounir B. Ibrahim, Bay Village, OH (US)

(73) Assignee: Tom Richards, Inc., Mentor, OH (US)

( * ) Notice: Subject to any disclaimer, the term of this patent is extended or adjusted under 35 U.S.C. 154(b) by 538 days.

(21) Appl. No.: 13/837,729

(22) Filed: Mar. 15, 2013

(65) Prior Publication Data

US 2014/0038118 A1 Feb. 6, 2014

Related U.S. Application Data

(60) Provisional application No. 61/679,334, filed on Aug. 3, 2012.

(51) Int. Cl.
*F24H 9/00* (2006.01)
*F24H 1/14* (2006.01)
(Continued)

(52) U.S. Cl.
CPC ..... *F24H 9/00* (2013.01); *F24H 1/142* (2013.01); *F24H 9/0015* (2013.01); *F24H 9/18* (2013.01);
(Continued)

(58) Field of Classification Search
CPC ..... F24H 9/0015; F24H 9/18; F24H 1/10; F24H 1/22; F24H 1/526; F24H 9/12;F24H 9/128; F24H 9/16; F24H 9/2028; F28F 1/003; F28F 1/02; F28F 1/00; F28F 13/12; F28D 7/10; F28D 7/106; F28D 7/1684; F28D 7/103; F25B 1/00
(Continued)

(56) References Cited

U.S. PATENT DOCUMENTS 1,327,774 A 1/1920 Plante
3,401,682 A 9/1968 Jakob
(Continued)

FOREIGN PATENT DOCUMENTS

CN 2583599 Y 10/2003
DE 198 35 229 2/1999
(Continued)

OTHER PUBLICATIONS

European Search Report of European Application No. 13174674.5 Dated Jul. 11, 2013.

*Primary Examiner* — Steven B McAllister
*Assistant Examiner* — Ko-Wei Lin
(74) *Attorney, Agent, or Firm* — Fay Sharpe LLP

(57) ABSTRACT

A heat exchanger includes a plurality of tubes wherein at least some of the tubes are elliptical or oval in cross section and each tube includes a longitudinal axis. Each elliptical tube includes a major axis and a minor axis. The plurality of tubes is arranged in a radial pattern such that the major axes of the elliptical tubes intersect a centerline of the heat exchanger. The plurality of tubes is connected to a heater mount and a heater is also connected to the heater mount. A securing element holds the plurality of tubes, the heater and the heater mount together. A tube liner can extend along the longitudinal axis of at least one of the elliptical or oval tubes of the plurality of tubes. If a tube liner is employed, a purge fluid flow channel is defined between an outer periphery of
(Continued)

the tube liner and an inner periphery of at least one of the elliptical or oval tubes of the plurality of tubes.

20 Claims, 10 Drawing Sheets

(51) Int. Cl.
*F24H 9/18* (2006.01)
*F28F 1/02* (2006.01)
*F28F 19/04* (2006.01)
*F28F 1/00* (2006.01)

(52) U.S. Cl.
CPC ..... *F28F 1/003* (2013.01); *F28F 1/02* (2013.01); *F28F 19/04* (2013.01)

(58) Field of Classification Search
USPC ..... 392/479, 480, 482, 495, 496; 165/154, 165/141, 140
See application file for complete search history.

(56) References Cited

U.S. PATENT DOCUMENTS

| | | | | |
|---|---|---|---|---|
| RE29,332 | E | 8/1977 | Bilbro et al. | |
| 4,206,806 | A | 6/1980 | Togashi | |
| 4,553,024 | A | 11/1985 | Findlay | |
| 4,755,331 | A * | 7/1988 | Merrill | F28D 5/02 165/172 |
| 4,778,977 | A | 10/1988 | Bleckman | |
| 4,791,277 | A * | 12/1988 | Montierth | E03B 7/12 219/535 |
| 4,805,694 | A | 2/1989 | Ayub | |
| 4,813,396 | A | 3/1989 | Sargeant et al. | |
| 5,027,425 | A | 6/1991 | Slomka | |
| 5,155,800 | A | 10/1992 | Rezabek et al. | |
| 5,329,988 | A | 7/1994 | Juger | |
| 5,531,266 | A | 7/1996 | Ragi et al. | |
| 5,590,240 | A | 12/1996 | Rezabek | |
| 5,875,283 | A | 2/1999 | Yane et al. | |
| 5,919,386 | A | 7/1999 | James | |
| 5,995,711 | A | 11/1999 | Fukuoka et al. | |
| 6,330,395 | B1 | 12/2001 | Wu | |
| 6,349,887 | B1 * | 2/2002 | Pyo | C23C 16/4481 239/137 |
| 6,477,324 | B1 | 11/2002 | Sun | |
| 6,782,195 | B2 | 8/2004 | Abras et al. | |
| 6,804,965 | B2 | 10/2004 | Abras | |
| 7,337,834 | B2 | 3/2008 | Antonijevic et al. | |
| 7,526,922 | B2 | 5/2009 | Abras | |
| 7,549,465 | B2 | 6/2009 | Gong et al. | |
| 7,565,065 | B2 | 7/2009 | Kato | |
| 7,809,254 | B2 | 10/2010 | Lindsay et al. | |
| 2005/0235926 | A1 * | 10/2005 | Thielert | C01B 17/0447 122/13.01 |
| 2007/0178029 | A1 | 8/2007 | Goebbel et al. | |
| 2007/0209788 | A1 | 9/2007 | Jing et al. | |
| 2007/0246206 | A1 | 10/2007 | Gong et al. | |
| 2009/0010625 | A1 | 1/2009 | Fowler et al. | |
| 2010/0181045 | A1 | 7/2010 | Bognarne Fejes | |
| 2012/0055660 | A1 * | 3/2012 | Walker | B21D 53/06 165/172 |

FOREIGN PATENT DOCUMENTS

| | | | |
|---|---|---|---|
| DE | 100 49 030 | | 4/2002 |
| EP | 0 238 955 | | 9/1987 |
| EP | 0 934 493 | B1 | 9/2005 |
| EP | 2 219 001 | | 8/2010 |
| FR | 2 676 533 | | 11/1992 |
| FR | 2 906 355 | | 3/2008 |
| GB | 398154 | | 9/1933 |
| JP | 4001389 | B2 | 10/2007 |
| JP | 2008116096 | A | 5/2008 |
| JP | 2012007772 | A * | 1/2012 |
| KR | 20020085532 | A | 11/2002 |
| SU | 1386843 | | 4/1988 |
| TW | M270342 | U | 7/2005 |
| WO | WO 0004745 | A1 | 1/2000 |
| WO | WO 01/18406 | | 3/2001 |

* cited by examiner

FIG. 1
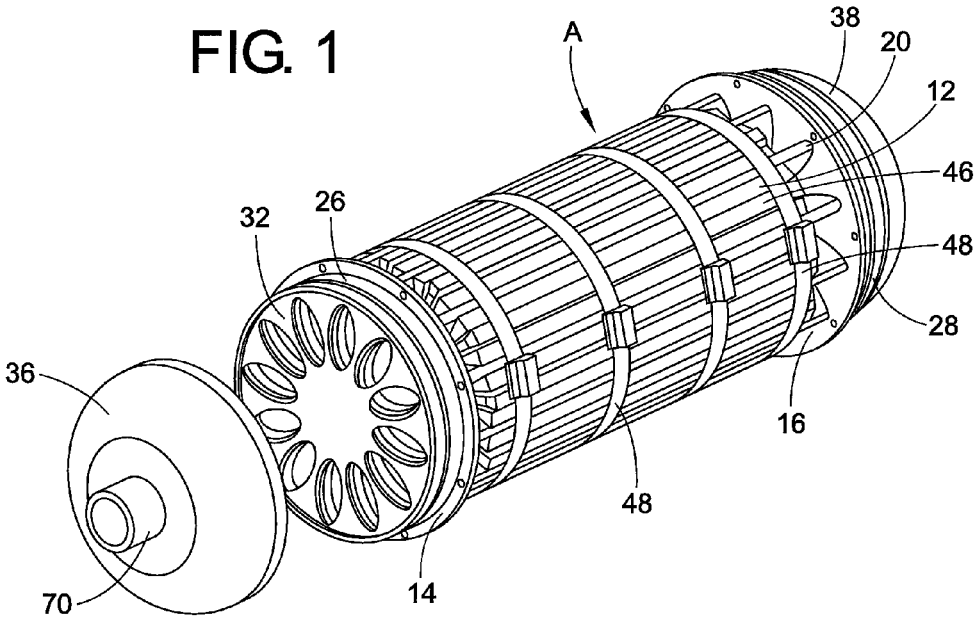
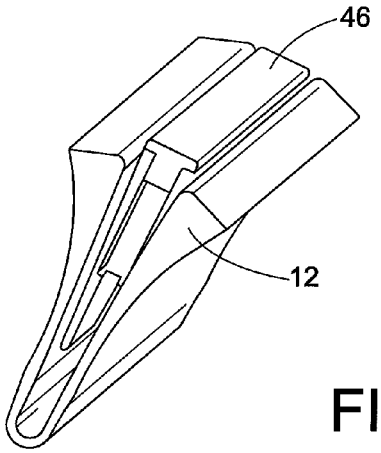
FIG. 2

IN-LINE ULTRAPURE HEAT EXCHANGER

This application claims priority from the U.S. Provisional Application Ser. No. 61/679,334 filed on Aug. 3, 2012, the subject matter of which is incorporated hereinto in its entirety.

BACKGROUND

The present disclosure relates to heaters for heating a liquid. More particularly, the disclosure relates to an inline heat exchanger which can be used to heat a corrosive fluid. If desired, a gas purge can also be used.

It is known to use a purge gas to remove permeate from a heater assembly in order to protect a metal heat exchanger surface. A patent pertaining to such an arrangement is entitled "Gas purged flexible cable type immersion heater and method for heating highly corrosive liquids", U.S. Pat. No. 4,553,024. Another similar patent is entitled "Purged grounded immersion heater", U.S. Pat. No. 5,875,283. The subject matter of both of these patents is incorporated hereinto by reference in their entirety. Both patents utilize a purge gas to remove permeate from the inside of a fluoropolymer tube encasing a heating element. The first element is a simple resistance wire heating coil. The second is a metal encased heating element which provides a ground plane for added safety.

It would be desirable to reduce the amount of expensive fluoropolymer materials which are employed in the existing designs, while still being able to perform the same functions. It would also be desirable to provide heat exchanger tubes aligned in a radial array in order to maximize the area per unit volume and allow for simplified assembly of the unit. It would further be desirable to maintain an uninterrupted flow path through the heat exchanger in order to provide the highest purity of the process fluid, i.e., the fluid which is being heated.

BRIEF DESCRIPTION

According to one embodiment of the present disclosure, there is provided a heat exchanger comprising a tube having a longitudinal axis wherein the tube is elliptical or oval in cross section. A tube liner extends longitudinally in the tube for accommodating a process fluid meant to be heated. A flow channel extends longitudinally between the tube and the liner for accommodating a purge fluid. A heater thermally contacts an exterior surface of the tube to heat same.

According to another embodiment of the present disclosure, a heat exchanger comprises a plurality of tubes wherein at least some of the tubes are elliptical or oval in cross section with each tube including a longitudinal axis. Each elliptical or oval tube includes a major axis and a minor axis. The plurality of tubes is arranged in a radial pattern, such that the major axes of the elliptical tubes intersect a center line of the heat exchanger. At least two of the plurality of tubes are thermally connected to a heater mount. A heater is thermally connected to the heater mount. A securing element holds the plurality of tubes, the heater and the heater mount together.

BRIEF DESCRIPTION OF THE DRAWINGS

FIG. 1 is an exploded perspective view of one embodiment of a heat exchanger according to the present disclosure;

FIG. 2 is a greatly enlarged perspective view of a portion of the heat exchanger of FIG. 1;

DETAILED DESCRIPTION

An in-line high efficiency, and high purity, heat exchanger/heater can include a number of unique design features that provide an efficient, compact heater/heat exchanger for use with high purity or highly corrosive fluids.

With reference now to FIG. 1, a heat exchanger A according to one embodiment of the present disclosure includes one or more heater mounts 12 and a pair of support discs or end plates 14 and 16. The heater mount or mounts can be made of a metal material, as are the end plates. A plurality of spaced heat exchange tubes 20 extend between the end plates 14 and 16. Both ends of all tubes are connected around each end of the tube to the respective end plate, such as by being welded, brazed or soldered thereto.

Figure 3:
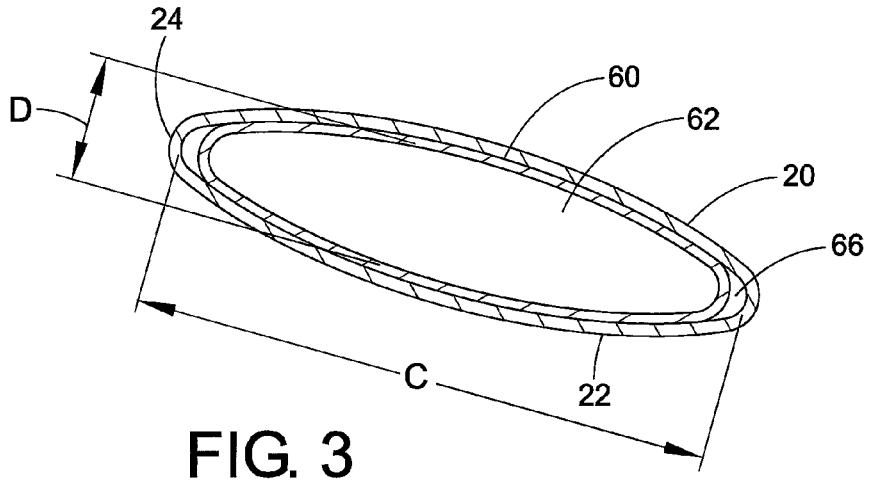
FIG. 3 is a greatly enlarged cross sectional view through one tube of the heat exchanger of FIG. 1.
Figure 4:
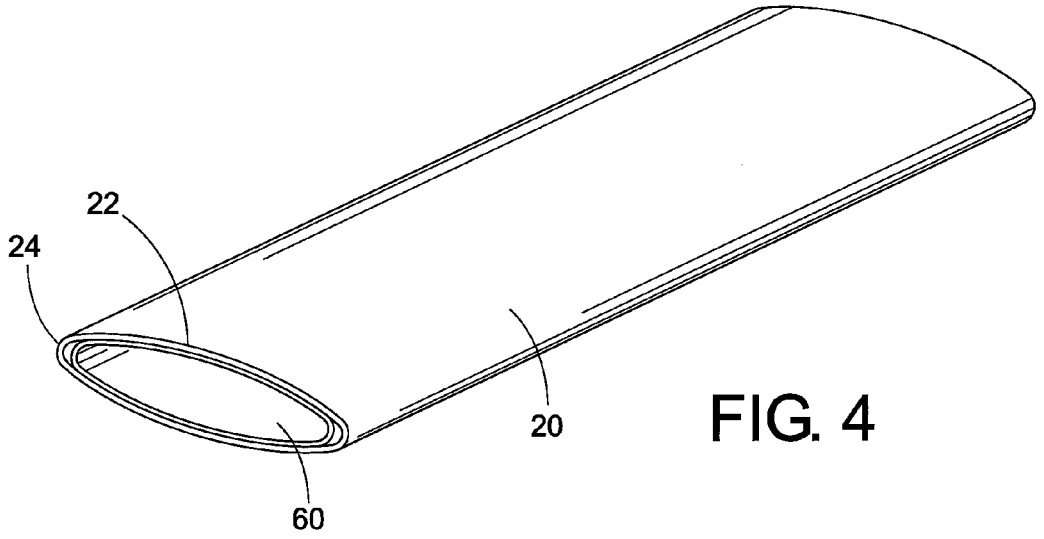
FIG. 4 is an enlarged perspective view of a heat exchanger tube employed in the heat exchanger of FIG. 1.

With reference now to FIGS. 3 and 4, each heat exchange tube can, in one embodiment, be elliptical or oval shaped so as to have a larger radius side wall 22 and a smaller radius side wall 24. Of course, it should be recognized that other tube configurations are also contemplated. As can be seen from the cross sectional view of FIG. 3, due to the generally elliptical cross sectional configuration of the heater tube 20, the heater tube includes a major axis C and a minor axis D. In the embodiment illustrated, the major axis C is oriented towards the smaller radius sidewall 24 and the minor axis D is oriented towards the larger radius sidewall 22. The elliptical or oval configuration of the heat exchange tubes allows for efficient heat transfer to and from the fluid or fluids flowing through the heat exchange tube 20.

With reference again to FIG. 1, in one embodiment purge manifolds 26 and 28 can be provided adjacent each of the end plates 14 and 16. A respective fluid tube sheath, such as at 32, can be positioned atop each of the purge manifolds. A respective end cap 36 and 38 is disposed atop each of the purge manifolds. It should be appreciated, however, that a fluid purge may not be needed under some circumstances. In that case, there is no need for purge manifolds and tube sheaths.

With reference now to FIG. 2, in this embodiment, a heater, which can be a cartridge heater 46, is wedged between opposing faces of the heater mount 12 which is made of metal. In one embodiment, the heater mount can be made of an extruded aluminum. Of course, other suitable metals can also be used. In the same vein, a variety of known heater types can be employed. In the embodiment disclosed, a generally U-shaped opening is provided between the two legs of the heater mount so as to accommodate a known elongated heater element, such as an electrically powered heater cartridge or cartridge heater assembly 46. In this way, an efficient thermal conduction path is provided between the cartridge heater assembly 46 and at least two heat exchange tubes 20. The heat exchange tubes 20 are in intimate contact with the outer surfaces of the respective legs of the heater mount 12 and the opposed sides of the heater are in contact with the inner opposing surfaces of the legs of the heater mount.

If a gas purge is required for the particular heat exchanger in question, a plastic liner 60 or chemically inert barrier, such as a Teflon sheath shown in FIGS. 3 and 4, is positioned within the heat exchange tube 20. As best shown in FIG. 3, a fluid flow path 62 is defined within the plastic liner and a purge flow path 66 is defined between the smaller radius ends of the plastic liner and the heat exchange tube. If the heat exchange tube 20 is made of stainless steel, a plastic liner may not be necessary for certain of the chemicals or fluids meant to be heated.

With reference again to FIG. 1, in one embodiment, the end cap 36 includes a port 70, such as an inlet port for the process fluid which is meant to be heated. An outlet port (not visible) would then be defined on the opposite end cap 38.

Holding the heater cartridges 46 in place are one or more tensioning bands 48, as illustrated in FIG. 1. The tensioning bands can also hold the one or more heater mounts 12 in place. The tapered design ensures uniform force is applied to the mating surfaces with a simple "tensioning band" 48 spaced along the length of the cartridge A.

Figure 5:
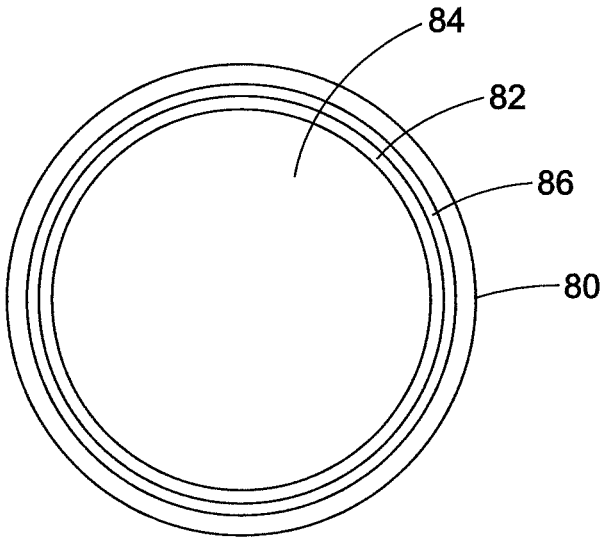
FIG. 5 is a cross sectional view of another embodiment of a heat exchanger tube according to the present disclosure.

With reference now to FIG. 5, a second embodiment of the present disclosure pertains to a heat exchange tube or outer containment vessel or pipe or tube 80 which can be made of a suitable metallic material or another type of thermally conductive material. Positioned within the outer containment vessel 80 is a chemically inert barrier or plastic liner 82. A fluid flow path 84 is defined within the plastic liner and a purge flow path 86 is defined in the toroidal gap between the outer periphery of the plastic liner 82 and the inner periphery of the containment conduit or tube 80.

Figure 6:
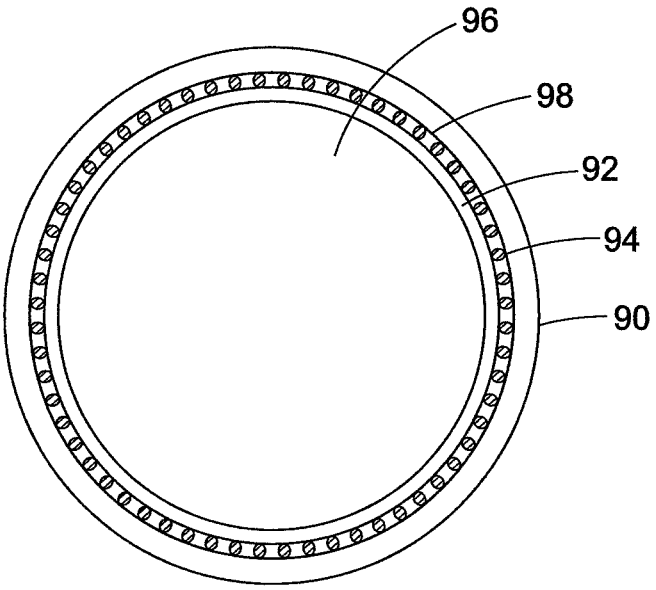
FIG. 6 is a cross sectional view of a still further embodiment of a heat exchanger tube according to the present disclosure.

With reference now to FIG. 6, a further embodiment of a heat exchange tube includes an outer containment conduit or sheath 90. Located within the sheath 90 is a chemically inert barrier or plastic liner 92. In this embodiment, a support braid 94 is employed between the plastic liner and the outer sheath. A fluid flow path 96 is defined within the plastic liner and a purge flow path 98 is defined in the toroidal area occupied by the support braid. Having a support braid located between the two concentric tubes ensures that purge media flow does not get blocked by excessive internal pressure.

Figure 7:
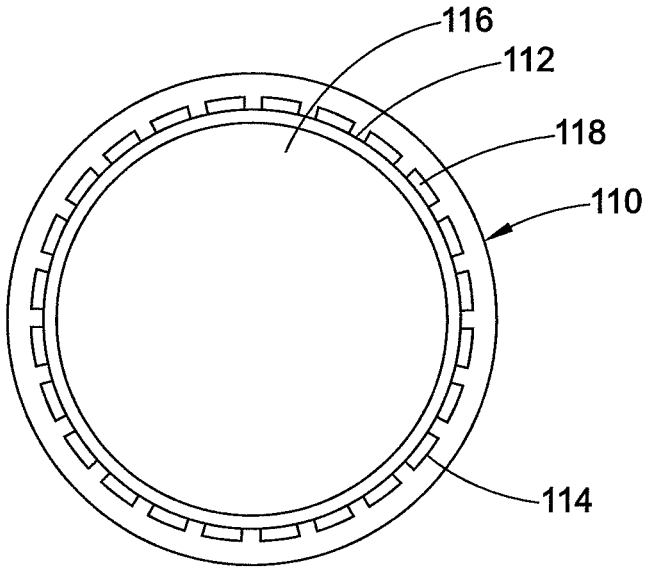
FIG. 7 is a cross sectional view of a yet further embodiment of a heat exchanger tube according to the present disclosure.

With reference now to FIG. 7, a still further embodiment of the present disclosure pertains to a heat exchange tube which comprises an outer support conduit 110 and a plastic liner 112 held therein. In this embodiment, a plurality of grooves 114 are defined in an inner periphery of the tube 110. The grooves can allow a purge fluid, such as a gas to flow longitudinally along the tube 110. To this end, the grooves can extend spirally around the inner periphery of the outer tube 110 or can simply extend generally longitudinally. A fluid flow path 116 is defined within the plastic liner 112 and a purge flow path 118 is defined between the outer wall of the plastic liner 112 and an inner surface of the tube 110, specifically at the grooves 114 defined in the outer tube 110. A metal tube having internal grooves between the two concentric tubes ensures that purge media flow does not get blocked by excessive internal pressure.

In one embodiment, the heat exchanger tubes are aligned in a radial array to maximize the area per unit volume; such a design also simplifies installation of heater elements when used as an electric heater. The heat exchange tubes include a thermally conductive heater mount 12 attached to them. The heater mounts fill the void created by the unusual shape of the heat exchanger tube and the heater cartridge 46 to be attached. The shape of the area now created by the heater mount is a wedge. This wedge shape allows the cartridge heater to be simply inserted from the outer perimeter of the heat exchanger. The use of a tensioning band 48 placed around the assembly, once all heaters are in place, provides force directed towards the center of the array, and thus a positive load between the heater cartridge and the heat exchanger. This configuration also improves overall efficiency by removing the heat from both sides of each cartridge, and likewise adding it to both sides of the exchange tube.

One embodiment of such a design is a 12 tube array. The application flow rates and overall power requirement needs, result in this number of tubes to achieve maximum efficiency. Obviously more or fewer tubes, as little as 3 or perhaps as many as 48, could be used in a similar array and provide the same design benefits. In fact, a very large array could be designed with several hundred tubes. In one embodiment, the heater exchanger could have inner and outer arrays with fluids passing around them. An inner and outer cartridge array could have the inner array with the cartridges loaded from the inside.

In the embodiment disclosed, the fluid to be heated flows inside the plastic (such as fluoropolymer) tubing 60, 82, 92, 112 rather than outside. This method allows for better heat transfer due to uniform high velocity flow at the surface of the entire tube area. This method also improves maintaining the cleanliness of the heated fluid by reducing the amount of stagnant areas within the heater assembly. The chemically inert tubing is supported on the outside with a suitable tube. Because the plastic tubing is relatively thin, permeation will occur. To ensure a long useful life of the heater assembly a gas purge or liquid purge flows between the inner tube and the outer support tubing. The purge fluid removes permeate from the annular space and reduces the corrosive effect.

The shape of the chemically inert barrier or metal tubing surrounding the plastic tubing is important to the effective operation of the heat exchanger assembly. There are four specific attributes to the shape that impact the performance of the design. As to an overall design, such as the one shown in FIG. 3, the first is to greatly improve the available heat exchange area per unit volume when compared to a round tube. This is important due to the relatively low rate of heat transfer for the plastic tubing used within the casing. The second feature is to ensure intimate contact between the plastic internal tubing and the surrounding support casing. The larger arched surface maintains contact force as the plastic tubing expands and contracts with varying temperatures. The difference in thermal expansion rates makes this a useful feature. The third attribute is what can be referred to as the "figure of merit". This is a ratio between the heat transfer rate and pressure drop across the tubing. A modified oval or elliptical shape is such that it maximizes the heat transfer while maintaining a relatively low pressure drop. Finally the shape allows for a purge media to flow between the plastic and metal tubes. The purge medium can be a gas or a liquid. The small radius in the oval provides a path for the purge fluid while providing mechanical support for the thin walled plastic tubing held in the heat exchanger tube.

In one embodiment, as shown in FIG. 3, the plastic tube contained within a metal tube is in the shape of an ellipse. The elliptical shape of the metal tube provides full support of the plastic tube while leaving sufficient open area in the minor radii to allow purge media flow. The major and minor radii of the modified ellipse can be varied to optimize the "figure of merit" as well as accommodate varying wall thicknesses of the plastic liner. The minor radius is proportional to liner wall thickness to ensure adequate support of the liner while providing a space for purge fluid.

Figure 8:
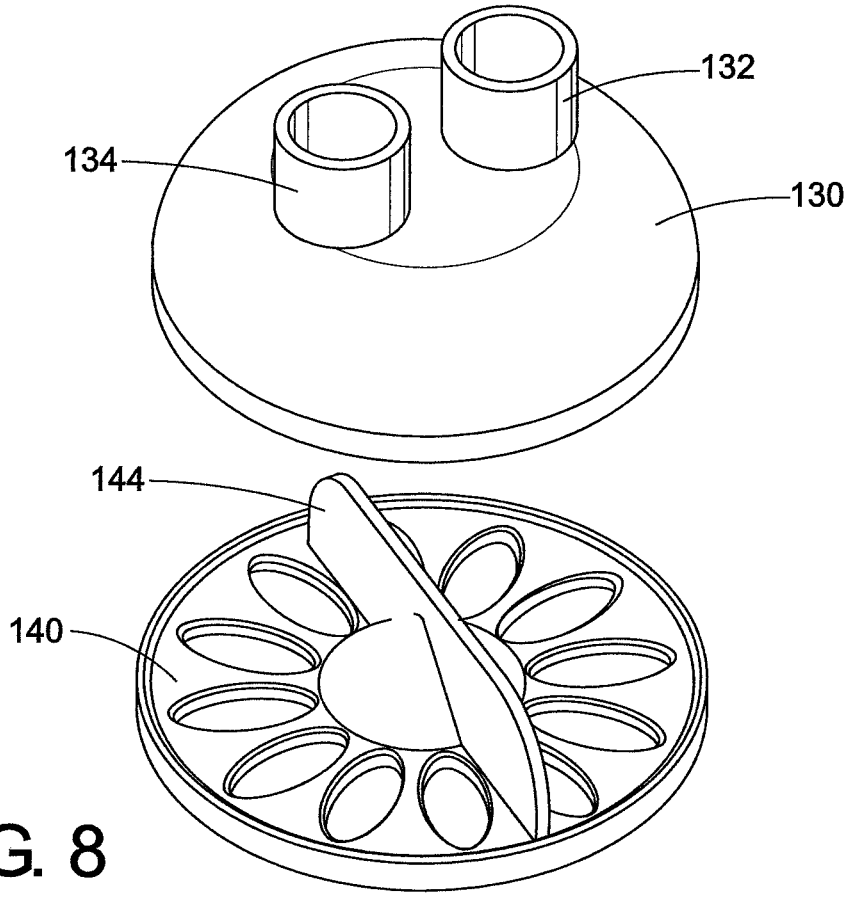
FIG. 8 is an exploded perspective view of one end of the heat exchanger according to another embodiment of the present disclosure.

With reference now to FIG. 8, another embodiment of the present disclosure is there illustrated. In this embodiment, an end cap 130 is provided with an inlet port 132 and an outlet port 134. Located adjacent to the end cap is a heat exchange tube sheath 140. Mounted on the tube sheath 140 is a configurable flow divider 144. An end cap 130 is used to manifold the ends of the exchanger. It is designed in such a way as to permit changing the flow of fluid thru the heat exchanger by simply adding baffles to the inside of the cap prior to final assembly of the manifold. This allows the heat exchanger operate at maximum efficiency based upon the specific application. The heat exchanger consists of multiple parallel paths. In one embodiment, twelve tubes are provided in a radial array. For use in very high flow recirculation applications all twelve tubes would be allowed to flow in parallel to minimize pressure drop. In the case of a low flow single pass application the twelve tubes could be operated in series to ensure adequate fluid velocity thru each tube, and thus maintain good heat transfer. The flow could similarly be divided into 2, 3, 4 or 6 parallel paths "tuned" to the specific application.

The drawing shown in FIG. 8 illustrates six parallel heat exchange tubes, with inlet and outlet ports on the same end. In the embodiment illustrated in FIG. 8, the other end cap would not have any inlet or outlet ports, but would, rather simply have a similar flow divider and all fluid flow would pass through the heat exchanger twice, the first time away from the inlet port 132 and the second time towards the outlet port 134.

Figure 9:
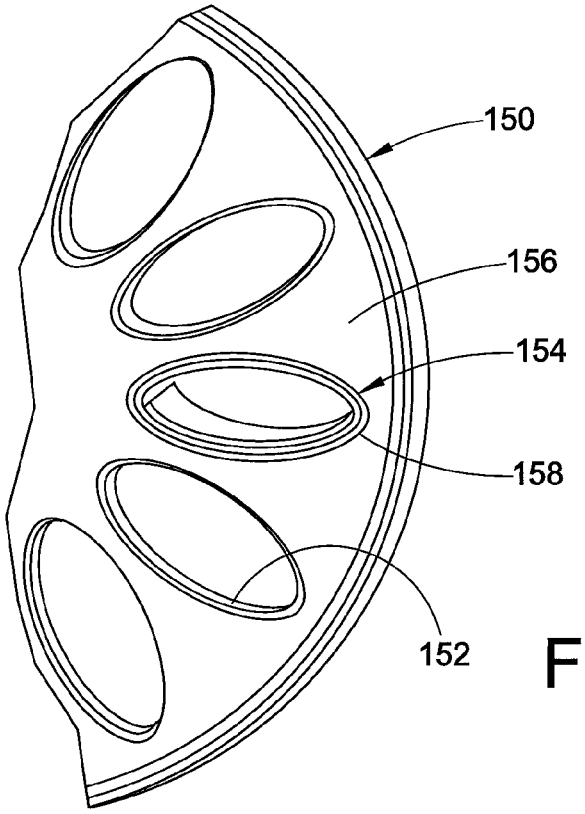
FIG. 9 is an enlarged perspective fragmentary view of an end portion of the heater exchanger of FIG. 1.

In the embodiment illustrated in FIG. 9, an end plate 150 is provided with a plurality of spaced plastic tubes 152 which extend within similarly shaped metal tubes (not visible). Each plastic tube terminates as at 154 and is there joined to a plastic tube sheath 156 which is positioned atop the end plate 150. If desired, a plastic support insert 158 can be located at this point.

Welding thin walled fluoropolymer tubing to a relatively thick cross section of like material is a challenge. The poor heat transfer of the fluoropolymer tends to "overheat" the thin section long before the thick section is hot enough to fuse the two parts. To overcome this issue the thin cross section of the tubing is inserted into the tube sheath for welding, and an additional thick walled tube section, the insert 158, is inserted into the thin walled tube effectively making it a similar cross section of the tube sheath. The shape of the oval tubing at this point is made closer to the shape of a round tube, thus maintaining a similar cross section area for the flow path. The increase in area at the point of the weld prevents what would otherwise form an orifice-like restriction to flow.

Figure 10:
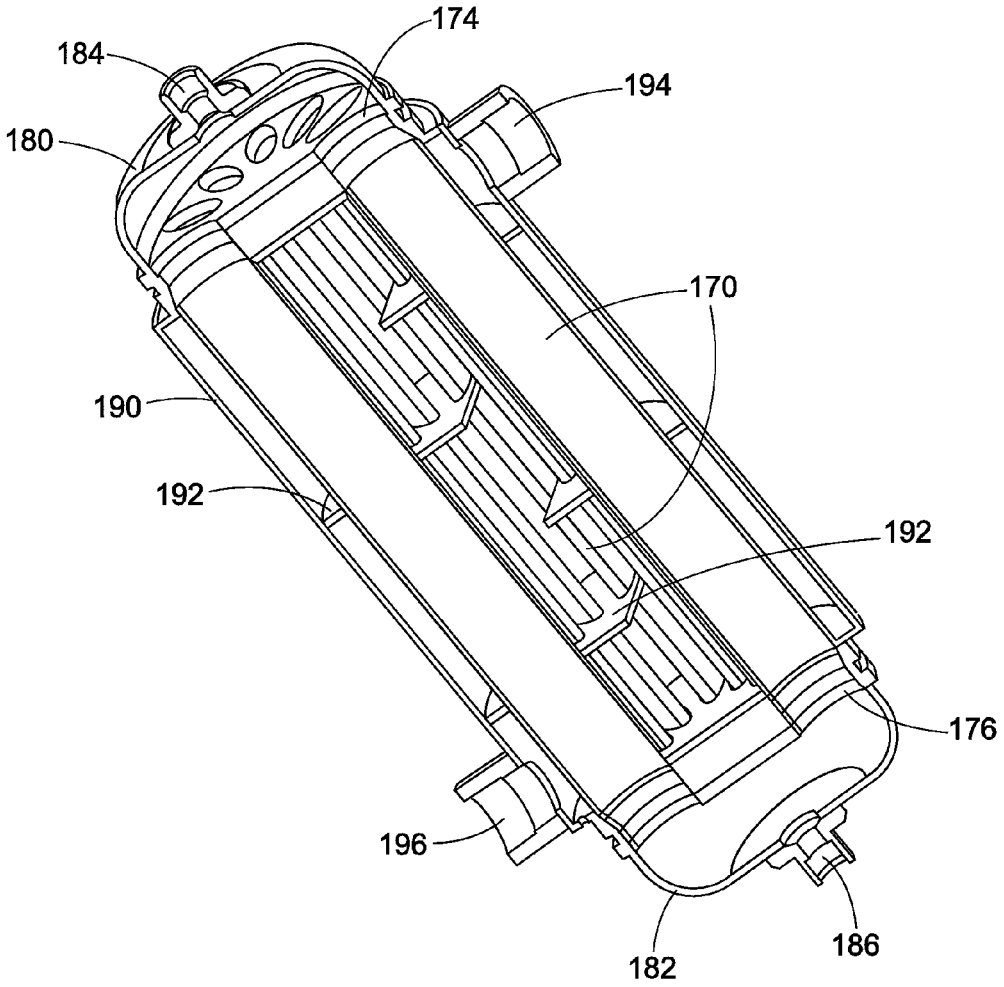
FIG. 10 is a cross-sectional view of a heat exchanger according to a third embodiment of the present disclosure.

With reference now to FIG. 10, another embodiment of a heat exchanger is there illustrated. In this embodiment, heat for the heat exchanger is provided by a liquid, rather than a plurality of electrically powered heater cartridges. Thus, in this embodiment, there is provided a plurality of tubes or conduits 170 which are arranged in a spaced relationship and connected to a pair of opposed end plates 174 and 176. A respective end cap 180 and 182 encloses the end plates. An inlet port for heating the process fluid, such as at 184, would be provided in one end cap, such as at 180, and an outlet port, such as at 186, would be provided in the other end cap 182. In this way, process fluid would flow along a longitudinal axis of the heat exchanger through one of the several conduits or tubes 170 to be heated. Such heating takes place via a shell 190 that encircles the plurality of conduits 170. In this embodiment, the shell is connected, such as by welding or the like to the pair of end plates 174 and 176. It is apparent that supports 192 extend between the shell 190 and the several tubes 170. The supports or dividers or baffles 192 can also function as flow directors to direct flow between the shell 190 and the several conduits or tubes 170. If desired, the one or more support members can extend between and be connected to at least one of the plurality of conduits 170 and the shell 190. An inlet port 194 is provided on one end of the shell and an outlet port 196 is provided on the other end thereof. In this way, a heating fluid can be introduced into the shell so as to heat the process fluid flowing through the tubes 170. It should be appreciated that in this embodiment, there is no gas purge taking place. Hence, the complexity of the gas purge system is eliminated.

Figure 11:
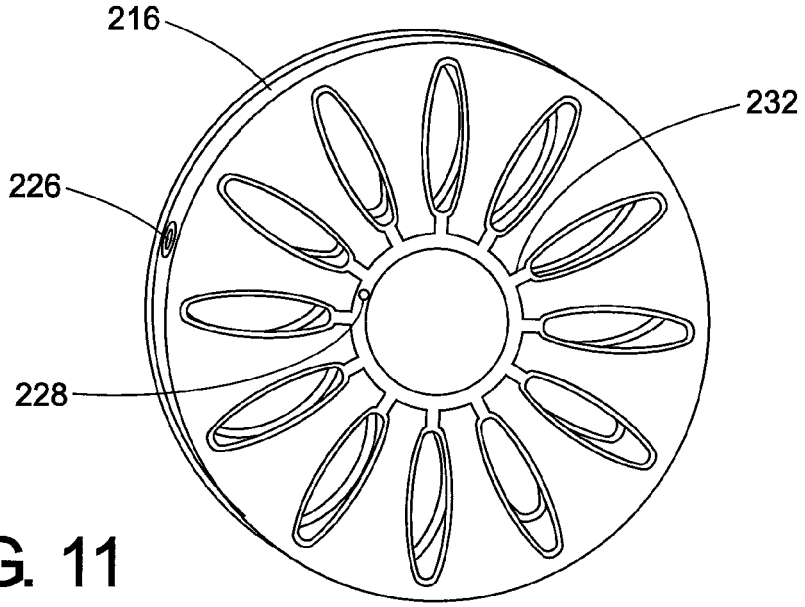
FIG. 11 is a perspective view of a heat exchanger according to a fourth embodiment of the present disclosure.
Figure 12:
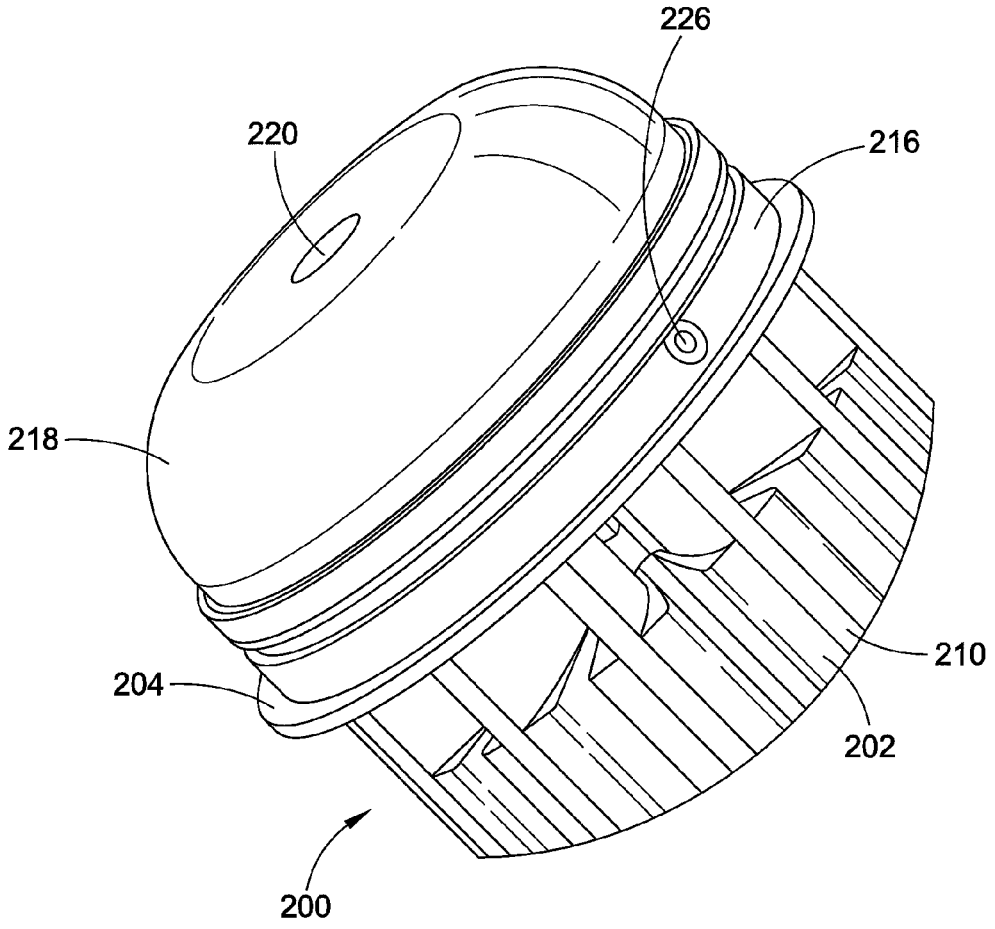
FIG. 12 is a perspective view of a heat exchanger of FIG. 11 showing additional components thereof.

With reference now to FIGS. 11 and 12, illustrated there is a design in which a purge fluid is employed between a metal tube and a plastic liner held within the metal tube. This embodiment includes a housing 200 which comprises a heater mount 202, as well as a plurality of heat exchange tubes 210. The housing also includes an end plate 204. It should be appreciated that the several heat exchange tubes 210 are welded to the end plate 204 as well as to an opposite end plate, not shown. An end cap 218 overlies the purge manifold 216. A port 220 is defined in the end cap. The purge manifold includes a purge port 226. With reference now also to FIG. 11, the purge system includes not only an outer purge fluid port 226, which can serve as either the inlet or the outlet of the purge system, but also includes an inner purge fluid distribution port 228, as well as a plurality of purge distribution grooves 232.

In one embodiment, the heat exchanger is assembled first with the elliptical tubes being welded to the tube sheath. Both ends of all tubes are fully welded around each end of the tube to the respective end plate or tube sheath. Once this is complete and the tubes are pressure tested, the purge manifolds containing the purge ports and distribution grooves are aligned and welded to the end plates, both top and bottom. This assembly is then pressure tested again. If the heat exchanger will be used with electrically powered heaters, then the heater mounts will be attached to each tube. At this point, plastic tube liners would be inserted into each tube if a gas purge system is desired for a particular installation. An O-ring (not illustrated) would then be placed into the face of the purge manifold and an additional plastic tube sheath placed on top of the purge manifold with the plastic tube liners extending through the plastic tube sheath.

Each tube liner is then welded to the tube sheath and pressure tested. With all the plastic tube welding complete, the fluid manifold is then welded to the tube sheath on each end. The process fluid to be heated would then flow into the fluid manifold and be distributed to each of the plastic lined tubes, which can be elliptical in cross section. The flow pattern through the tubes could be modified by inserting the appropriate flow divider, if one is employed, into the fluid manifolds prior to welding. The purge fluid, which as mentioned can be gas or liquid, would enter the purge port through the cross drilled hole and be distributed to each tube via the grooves in the purge manifold plate, such as in the embodiment illustrated in FIG. 11. The purge gas would then flow between the tube wall and the outside wall of the plastic liner. The purge flow is expected to flow through all of the support tubes in parallel from one end of the heater system to the other.

It should be apparent that all heating of the process fluid is done via conduction. Specifically, the heater cartridge 46 conducts heat to the heater mount 12 which in turn conducts heat to the outer surface of the metal heat exchanger tube 20. The heat exchanger tube, in turn, conducts heat to the plastic liner 60. The plastic liner, in turn, conducts heat to the process fluid flowing within the liner. For this reason, it is important that the several elements are firmly in contact with each other in the heater assembly.

Disclosed has been an ultrapure, high efficiency, configurable, in-line heat exchanger for heating or cooling corrosive or sensitive fluids includes a set of heat exchange tubes which are aligned and mounted together. The heat for the heat exchanger may be provided from a number of sources including a common electrically energized resistive type heating element, a PTC based heating element, a Peltier heater/chiller device, or externally heated/cooled fluid. The heat exchanger can be configured to efficiently accommodate a broad range of fluids and applications.

In one embodiment, a plurality of heat exchanger tubes are arranged in a radial pattern to maximize the heat exchange surfaces in a given volume while simultaneously providing an efficient means for uniformly removing heat from both sides of a heater cartridge and transferring the heat to both sides of the heat exchange tube. The wall of the heat exchanger can be constructed from a range of materials to provide optimum heat transfer and chemical compatibility. Fluids requiring ultrapure heating or cooling could utilize a heat exchange tube lined with an appropriate chemically inert barrier such as a fluoropolymer (e.g., Teflon), plastic, glass or ceramic coating. The shape of the heat exchange tube can be engineered to maximize the ratio of heat transfer to pressure drop, or "figure of merit". The shape desirably allows for optimum contact between the fluoropolymer liner and the heat exchange tube throughout the full range of use temperatures and pressure ratings of the heat exchanger. In addition, the shape could allow for a fluid purge to be introduced between the heat exchanger wall and the fluoropolymer liner to remove any permeate that may transfer through the wall of the chemically inert barrier/fluoropolymer liner.

Figure 13:
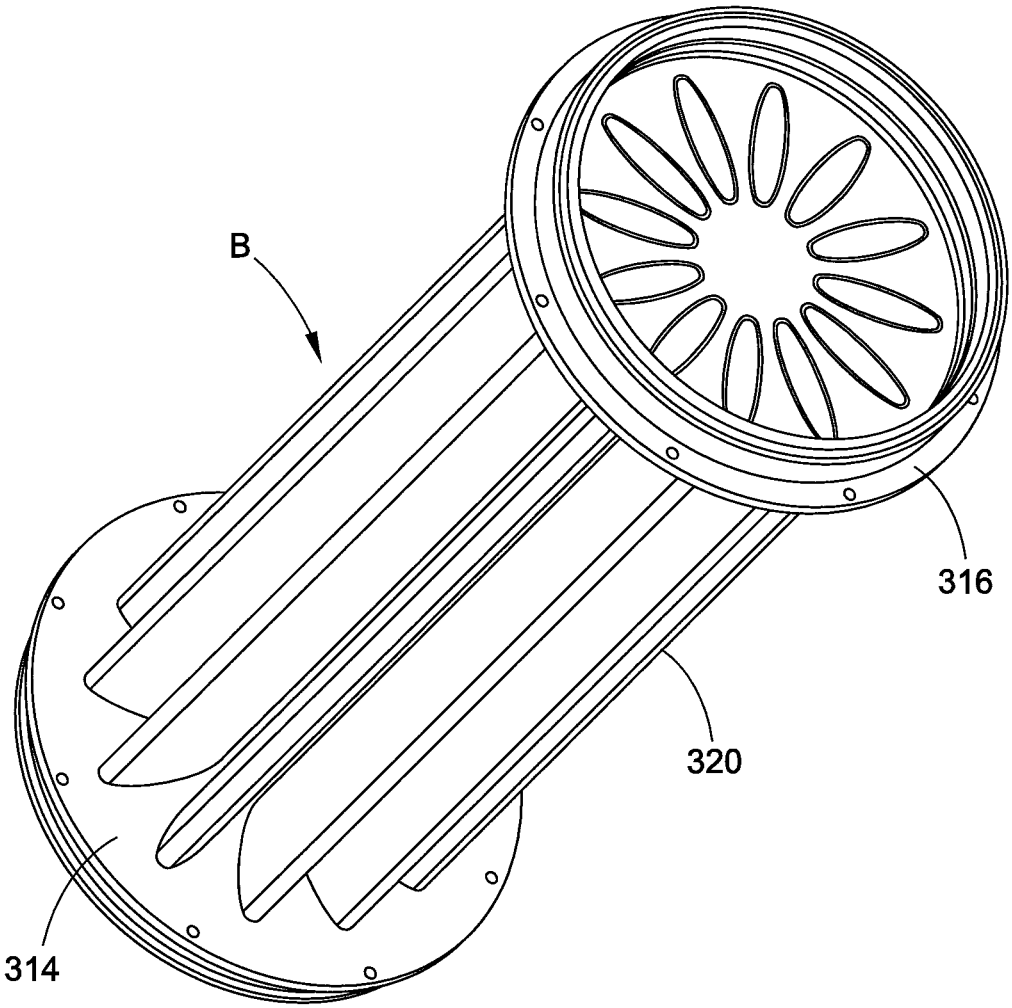
FIG. 13 is a perspective view of a heat exchanger according to still another embodiment of the present disclosure in a partially assembled condition.

With reference now to FIG. 13, a heat exchanger B according to still another embodiment of the present disclosure is there illustrated. In this embodiment, the heat exchanger includes a body comprising a plurality of heat exchange tubes 320 mounted on respective ends to first and second support discs or end plates 314 and 316. The tubes 320 can be welded or otherwise suitably connected to the support discs. It is evident that the ends of the heat exchange tubes open through the support discs 314 and 316. The heat exchange tubes are generally elliptical in cross section, such that they have a major axis and a minor axis. The major axes of the several heat exchange tubes 320 are oriented such that they point towards and radiate away from a central longitudinal axis 327 (FIG. 15) of the heat exchanger body. The benefit of this arrangement is that an efficient spacing of the heat exchange tubes can be achieved with the disclosed radial array of heat exchange tubes. It is believed that the radial array configuration illustrated in FIG. 13 is more efficient from a heat transfer perspective than known heat exchanger tube designs. The heat exchange tubes 320 can be made of a suitable metal, such as stainless steel or titanium. Of course, any other conventional metal could also be employed depending upon the chemical properties of the process fluid which flows through the heat exchanger tubes 320 and is meant to be either heated or cooled. In the disclosed embodiment, the fluid is meant to be heated.

Figure 14:
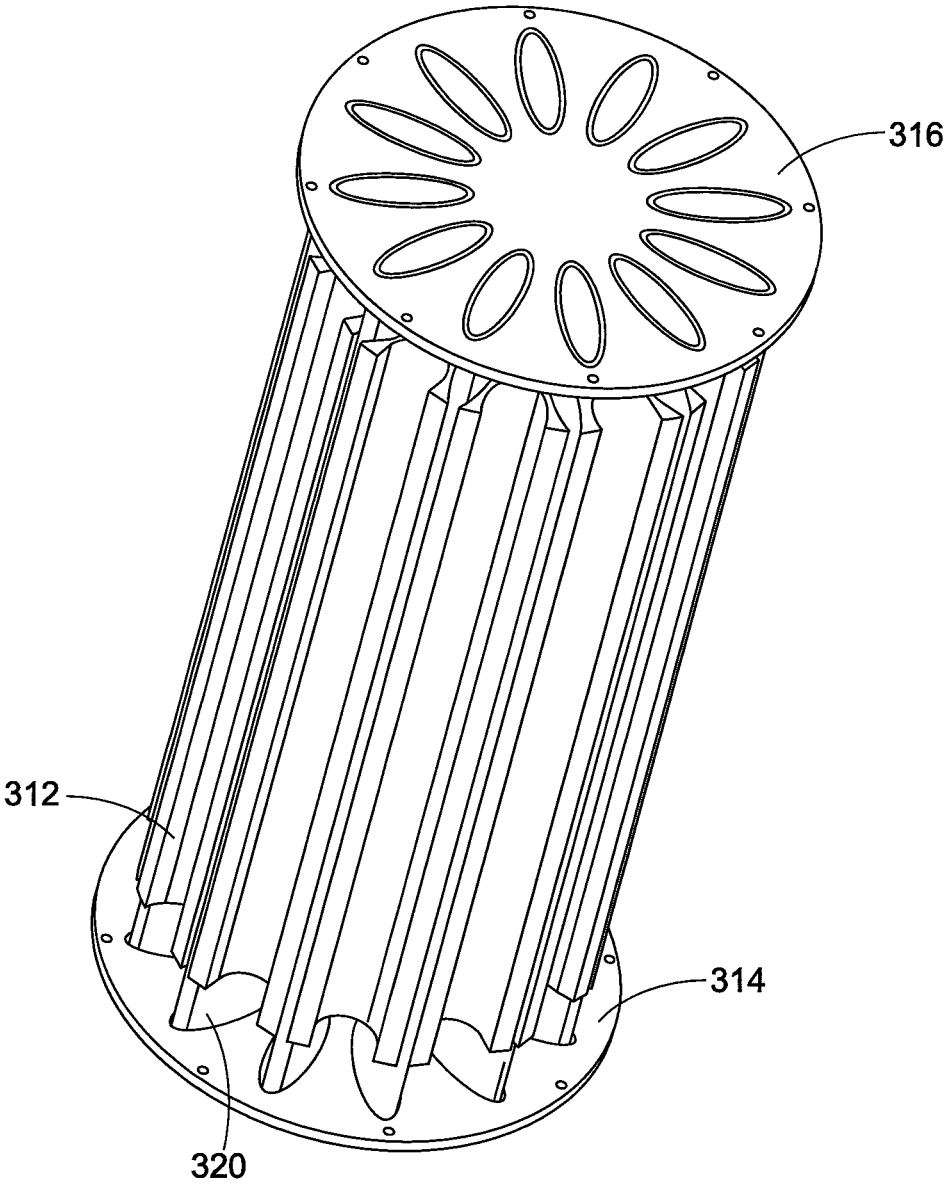
FIG. 14 is a perspective view of the heat exchanger of FIG. 13 after the heater mounts have been added.
Figure 15:
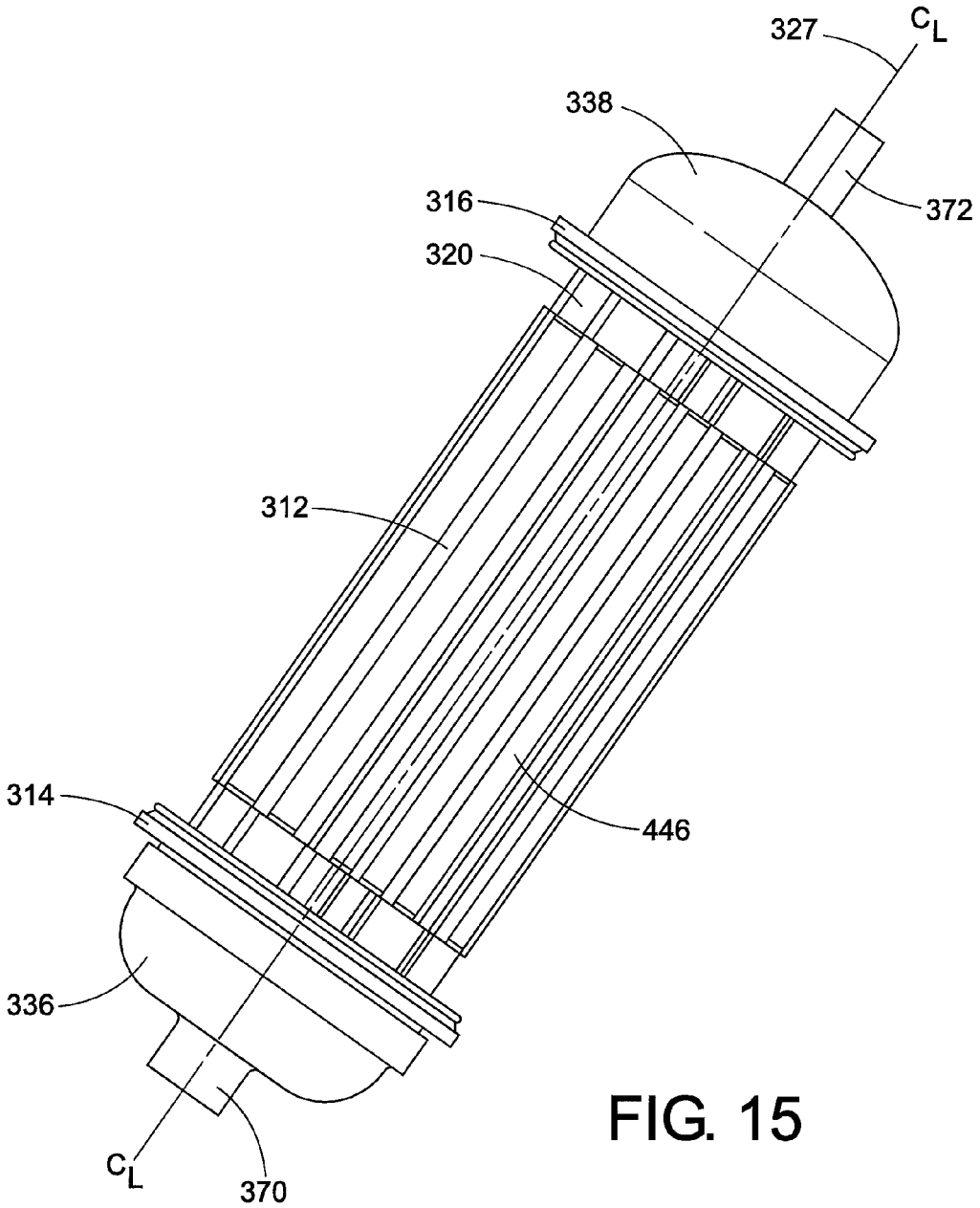
FIG. 15 is an assembled view of the heat exchanger of FIGS. 13 and 14 after the end caps and heaters have been added.

With reference now to FIG. 14, it can be seen that disposed between each pair of heat exchanger tubes 320 is a heater mount 312. The heater mount in this embodiment is generally U-shaped in nature such that it contacts the outer surfaces of a pair of adjacent heater tubes 320. Each heater mount includes a central generally U-shaped channel which is meant to accommodate a heater element 446 (FIG. 15). Thus, a plurality of heater mounts and heaters can be employed in the heat exchanger design illustrated in FIGS. 13-15. One benefit of this arrangement is that any heater 446 which malfunctions can be easily replaced with another heater. Similarly, if one of the heater mounts needs to be changed out, this can be easily accomplished as well. It should be appreciated that missing from FIG. 15 is a securing element for securing the heater mounts and heaters in place on the heat exchanger, such as the securing element or tensioning band illustrated in FIG. 1.

With reference now to FIG. 15, a first end cap 336 and a second end cap 338 are positioned on the respective heater support discs 314 and 316. In the design illustrated, an inlet port 370 is located on the first end cap 336 and an outlet port 372 as located on the second end cap 338.

In this embodiment, no fluid purge is provided. Rather, the process fluid simply flows in through inlet port 370 and through the several heat exchange tubes 320 towards the second end cap 338 and out the outlet port 372. While the process fluid flows through the several heat exchange tubes, it is heated by the heater elements 446. For this purpose, the heater elements pass heat via conduction to the heater mounts or heat sinks 312, which in turn conduct the heat to the heat exchange tubes 320. Due to the elliptical construction of the heat exchange tubes 320, their major faces are in intimate contact with the respective legs of a pair of adjacent heater mounts or heat sinks 312, thus leading to an efficient heat transfer path from the heater elements 446 to the process fluid flowing through the heat exchange tubes 320.

While a plurality of separate heater mounts 312 have been illustrated, it should be apparent that other embodiments of heater mount structures or heat sink designs could be employed instead. For example, a pair of heat sink halves could be mounted to each side of the heat exchanger so as to each accommodate about half the tubes of the heat exchanger B. Alternatively, the heater mounts could be made integral with the first and second support discs and made in a first operation with the heat exchange tubes then fitted through the support discs and between flanges of the heater mount in a second operation. The heater elements could also be designed so that they fasten to the heater mount construction. In such a design, perhaps the tensioning bands illustrated in FIG. 1 would not be necessary.

The instant disclosure has been described with reference to several embodiments. Obviously, modifications and alterations will occur to others upon reading and understanding the preceding detailed description. It is intended that the disclosure be construed as including all such modifications and alterations insofar as they come within the scope of the appended claims or the equivalents thereof.

The invention claimed is:

1. A heat exchanger comprising:

a tube having a longitudinal axis, wherein the tube is elliptical or oval in cross section so that the tube has a major axis and a minor axis;

a tube liner extending longitudinally in the tube and including a first end and a second end, wherein a process fluid meant to be heated flows through the tube liner from the first end to the second end thereof, wherein the tube liner is relatively flexible and the tube is relatively rigid so that the tube liner conforms to the shape of the tube and is configured to contact the tube along the tube's minor axis and is spaced from at least one section of the tube along the tube's major axis;

a flow channel extending longitudinally between the tube and the tube liner for accommodating a purge fluid; and an electrically resistive heating element thermally contacting an exterior surface of the tube to heat the exterior surface of the tube.

2. The heat exchanger of claim 1 further comprising a heater mount which includes an elongated channel for accommodating the heater element and wherein the heater mount includes a first surface and a second opposite surface wherein the heater element is adapted to contact the first surface of the heater mount and the tube is adapted to contact the second surface of the heater mount such that the heater mount is positioned between the heater element and the tube.

3. The heat exchanger of claim 2 wherein the tube comprises a metal material, the heater mount comprises a metal material.

4. The heat exchanger of claim 1 wherein the tube liner comprises a chemically inert material.

5. A heat exchanger comprising:

a plurality of tubes wherein at least some of the tubes are elliptical or oval in cross section, each tube including a longitudinal axis, and each elliptical or oval tube including a cross section including a major axis and a minor axis, wherein the plurality of tubes is arranged in a radial pattern around an axial centerline of the heat exchanger such that the major axis of each of the elliptical or oval tubes intersects the axial centerline of the heat exchanger;

a heater mount to which at least two of the plurality of tubes are thermally connected, the heater mount being positioned between the at least two of the plurality of tubes;

an electrically resistive heating element mounted to and thermally connected to the heater mount; and a securing element for holding the plurality of tubes, the heater and the heater mount together.

6. The heat exchanger of claim 5 wherein the heater element comprises a heater cartridge and the heater mount comprises a channel for accommodating the heater cartridge such that the cartridge is held by the heater mount between the at least two of the plurality of tubes.

7. The heat exchanger of claim 5 further comprising an end plate or support disc located adjacent each end of the plurality of tubes.

8. The heat exchanger of claim 7 further comprising a flow divider mounted to the end plate or support disc and an end cap mounted over the flow divider.

9. The heat exchanger of claim 8 wherein the end cap comprises an inlet port and, spaced therefrom, an outlet port.

10. The heat exchanger of claim 8 wherein the inlet port communicates with a first set of the plurality of tubes located on a first side of the flow divider and the outlet port communicates with a second set of the plurality of tubes located on a second side of the flow divider.

11. The heat exchanger of claim 8 wherein the flow divider is configurable.

12. The heat exchanger of claim 7 further comprising a tube liner extending along the longitudinal axis of at least one of the elliptical or oval tubes of the plurality of tubes; and a purge fluid flow channel defined between an outer periphery of the tube liner and an inner periphery of the at least one of the elliptical or oval tubes of the plurality of tubes.

13. The heat exchanger of claim 12 further comprising a purge manifold mounted to one of the end plates or support discs and fluidly connecting with each of the plurality of tubes.

14. The heat exchanger of claim 13 further comprising an end cap mounted over the purge manifold.

15. The heat exchanger of claim 13 further comprising at least one of a purge port and a purge fluid distribution groove located on said purge manifold.

16. The heat exchanger of claim 5 wherein the plurality of tubes are spaced from each other.

17. The heat exchanger of claim 16 wherein a heater mount is positioned between each pair of the plurality of tubes.

18. A heat exchanger comprising:

a first tube and, spaced therefrom, a second tube, wherein the first and second tubes are each elliptical or oval in cross section;

a first tube liner and a second tube liner, wherein the first and second tube liners extend along a longitudinal axis of a respective one of the first and second tubes, wherein a process fluid meant to be heated flows through the first and second tube liners;

a first flow channel defined between the first tube liner and the first tube wherein a purge fluid flows through the first flow channel;

a second flow channel defined between the second tube liner and the second tube wherein the purge fluid flows through the second channel;

a heater mount positioned between and contacting the first and second tubes; and, a heater cartridge mounted to and thermally connected to the heater mount.

19. The heat exchanger of claim 18 wherein the heater cartridge comprises an elongated body and the heater mount comprises a channel for accommodating the elongated body.

20. The heat exchanger of claim 18 wherein the heater mount includes an elongated channel for accommodating the heater cartridge.

* * * * *